US006336565B1

(12) United States Patent
Merkel et al.

(10) Patent No.: US 6,336,565 B1
(45) Date of Patent: Jan. 8, 2002

(54) ARTICULATING TRUSS BOOM

(75) Inventors: Joseph J. Merkel, 4835 N. 73rd St., Milwaukee, WI (US) 53218; Al Jubeck, Hubertus; Michael W. Wallschlaeger, Jackson, both of WI (US)

(73) Assignee: Joseph J. Merkel, Milwaukee, WI (US)

( * ) Notice: Subject to any disclaimer, the term of this patent is extended or adjusted under 35 U.S.C. 154(b) by 0 days.

(21) Appl. No.: 09/201,930

(22) Filed: Dec. 1, 1998

(51) Int. Cl.[7] ..... B66C 23/44
(52) U.S. Cl. ..... 212/168; 212/180
(58) Field of Search ..... 212/168, 177, 212/179, 180, 199, 245, 293; 414/607, 723, 724, 744.1, 744.2, 744.3, 744.4, 744.5, 744.6, 744.7, 744.8, 688, 689, 690, 691, 692, 693, 694, 695.5, 695.6, 695.7, 695.8, 686

(56) References Cited

U.S. PATENT DOCUMENTS

| | | | | | |
|---|---|---|---|---|---|
| 613,741 | A | * | 11/1898 | Vaughn | |
| 907,631 | A | * | 12/1908 | McGiffert | 212/293 |
| 2,646,182 | A | | 7/1953 | Maas | 212/660 |
| 2,990,074 | A | * | 6/1961 | Berquist et al. | 414/607 |
| 3,002,638 | A | | 10/1961 | Needy | 214/132 |
| 3,092,259 | A | * | 6/1963 | Swanson | 414/724 |
| 3,139,200 | A | * | 6/1964 | Burkhart | |
| 3,374,901 | A | * | 3/1968 | Ferwerda | 212/175 |
| 3,580,405 | A | * | 5/1971 | Siegel et al. | |
| 3,589,539 | A | * | 6/1971 | Witwer | |
| 3,807,108 | A | * | 4/1974 | Johnston | 52/115 |
| 3,891,065 | A | * | 6/1975 | Iijima et al. | |
| 3,929,239 | A | * | 12/1975 | Shumaker | 212/245 |
| 3,985,248 | A | | 10/1976 | Liegel et al. | 214/141 |
| 4,082,197 | A | | 4/1978 | Stedman | 214/132 |
| 4,085,855 | A | * | 4/1978 | Worback | 91/420 |
| RE30,021 | E | | 6/1979 | Olson et al. | 414/547 |
| 4,159,059 | A | | 6/1979 | Christenson et al. | 414/724 |
| 4,185,945 | A | * | 1/1980 | Gill | 414/694 |
| 4,221,531 | A | * | 9/1980 | Baron et al. | 414/694 |
| 4,243,148 | A | * | 1/1981 | Lampson | 212/196 |
| 4,251,181 | A | | 2/1981 | Drott et al. | 414/723 |
| 4,349,307 | A | * | 9/1982 | Klem | 414/686 |
| 4,382,743 | A | | 5/1983 | Newell | 414/692 |
| 4,493,426 | A | | 1/1985 | Sterner | 212/261 |

(List continued on next page.)

OTHER PUBLICATIONS

Strimech Advertising (Series 6000C, 6006C, 6008C).

Photograph—FSA Articulated Truss Boom.

Caterpillar, *TH63 Telescopic Handler*, 1995, U.S.A.

*Primary Examiner*—Thomas J. Brahan
(74) *Attorney, Agent, or Firm*—Boyle Fredrickson Newholm Stein & Gratz; Michael J. Gratz

(57) ABSTRACT

An articulating truss boom for use with a lifting machine is described. The articulating truss boom assembly includes an articulating truss boom frame, a stationary support member attachable to a lifting machine, and an internal pivot assembly having a vertical pivot axis interposed between and providing the connection between the stationary support member and the articulating truss boom frame. The articulating truss boom frame is capable of pivoting with respect to the stationary support member about the vertical pivot axis in a horizontal plane transverse to the vertical pivot axis. She articulating truss boom assembly includes a hydraulic assembly which includes a metering valve having a removable restrictor inserted therein. The removable restrictor has a constricted channel therethrough to limit the hydraulic fluid channeled to the hydraulic assembly. Rubber shock absorbing pads may be attached to one of the attached to one of the stationary member and the articulating truss boom frame to prevent direct contact therebetween and minimize vibrational swaying.

16 Claims, 8 Drawing Sheets

U.S. PATENT DOCUMENTS

| | | | | | |
|---|---|---|---|---|---|
| 4,571,146 | A | * | 2/1986 | Eriksson | 414/687 |
| 4,632,630 | A | | 12/1986 | Maki et al. | 414/700 |
| 4,741,663 | A | * | 5/1988 | Kennedy | 414/695.5 |
| 4,860,788 | A | | 8/1989 | Asaoka | 137/491 |
| 4,960,359 | A | | 10/1990 | Lovitt, Jr. | 414/686 |
| 5,073,077 | A | | 12/1991 | Altman | 414/11 |
| 5,127,791 | A | | 7/1992 | Attman | 414/786 |
| 5,169,281 | A | * | 12/1992 | Boisture | 414/724 |
| 5,570,991 | A | * | 11/1996 | Swenson et al. | 414/685 |
| 5,850,704 | A | * | 12/1998 | Harinen | 414/723 |
| 5,901,750 | A | * | 5/1999 | Kozinski | 138/45 |

* cited by examiner

ARTICULATING TRUSS BOOM

BACKGROUND OF THE INVENTION

The present invention relates generally to material handling attachments. In particular, the invention relates to an articulating truss boom that is securely attached to the end of a lifting machine. The articulating truss boom has an internal pivot joint that permits secure horizontal movement and usage of the articulating truss boom.

In the construction industry it is common to utilize attachments on material handling or other lifting machines in order to increase both the height and reach of the lifting machines. In addition, it is often necessary to refine the placement of such attachments as truss booms for carrying housing trusses. For example, after a material handling machine with an associated telescoping boom or other lifting machine has positioned a truss boom as close to its intended location as is practical in the vertical direction, it may be necessary to refine the orientation of the attachment in the horizontal direction. Previously, changing the horizontal orientation of the attachment involved moving the entire material handling or lifting machine and repositioning the entire apparatus for another attempt, which would not guarantee optimal orientation of the attachment. This procedure is time-consuming and potentially dangerous, moving the entire material handling machine may involve removing stabilizers and leveling equipment, backing up and repositioning the material handling machine with relatively heavy loads. Additionally, it may not always be possible to move the material handling machine closer to the desired location, as is the case when the machine would be parallel to a wall.

It would be advantageous to be able to place the truss boom into its final horizontal position by simply pivoting the truss boom while the truss boom was still securely attached to the telescoping boom or other implement of the material handling or lifting machine.

U. S. Pat. No. 4,159,059, issued to Christenson et al, discloses a truss boom for a material handling truck that is shown to horizontally move with the assistance of a fork assembly, tilt cylinder and the outer arm of an outer boom. The use of such a structure is dependent upon the availability of a fork lift or other fork assembly. Additionally, the fork assembly engages the truss boom and together they are pivoted by the tilt cylinder which is positioned between the fork assembly and the boom. The additional weight of the fork assembly on the load side of the pivot point significantly decreases the potential extension length and the load bearing capabilities of the truss boom, particularly at near limit extension lengths and loads for the particular machine. It would be advantageous, therefore, to have an articulating truss boom that increased the load bearing capabilities of the machine and that does not require the use of a particular type of machine.

Additionally, it is found that when a load in a truss boom, for example, is moved to the limit of its pivot arch in the horizontal direction, a contact is made between the pivot joint and the truss boom frame. This contact results in a relative motion of the entire machine due to the vibration of the contact, potentially a dangerous occurrence. It would therefore also be advantageous to provide some shock absorbing capability of the articulating truss boom to minimize the direct metal to metal contact which may cause undesirable vibrational swaying. Although the prior art discloses a truss boom that with assistance is capable of some horizontal movement with limited loads, it would be advantageous to have an articulating truss boom that solves the aforementioned problems not solved by the prior art.

SUMMARY OF THE INVENTION

The present invention provides an articulating truss boom that overcomes the aforementioned problems, and provides a truss boom that is capable of horizontally pivoting while carrying an appropriate load.

In accordance with one aspect of the invention, an articulating truss boom assembly for use with a lifting machine is provided and includes an articulating truss boom frame. The articulating truss boom assembly comprises a stationary support member which is attachable to a lifting machine, and an internal pivot assembly. The internal pivot assembly has a vertical pivot axis and is interposed between and provides a connection between the stationary support member and the articulating truss boom frame. The articulating truss boom frame is capable of pivoting with respect to the stationary support member about the vertical pivot axis in a horizontal plane. The horizontal plane is transverse to the vertical pivot axis.

In accordance with another aspect of the invention an articulating truss boom assembly for attachment to a lifting machine includes a stationary support member. The stationary support member includes a coupling assembly for coupling the stationary support member to the lifting machine. The coupling assembly comprises a support beam and a pair of securing members extending therefrom. Each securing member includes a hook portion and a securing lobe having an aperture therein. The hook portions and the securing lobes are capable of locking engagement with the lifting machine. The stationary support member further includes a first pair and a second pair of parallel stationary member support plates. Each pair of stationary member support plates has an aperture and includes a reinforcement plate transversely connected therebetween.

The articulating truss boom assembly further includes an articulating truss boom frame having a first pair and a second pair of truss boom support plates. Each pair of parallel truss boom support plates has an aperture and includes a truss boom frame reinforcement plate transversely connected therebetween. A pivot pin having a pivot sleeve is interposed between the stationary member and the articulating truss boom frame. An actuator member is connected to the pivot sleeve for pivoting the articulating truss boom frame in a horizontal pivot plane transverse to the pivot pin. The articulating truss boom assembly further includes a hydraulic assembly connected to the actuator to provide hydraulic fluid to the actuator and to facilitate pivoting of the articulating truss boom frame. The first and second pair of parallel stationary member support plates and the first and second pairs of parallel truss boom support plates are interlaced such that the parallel apertures of the stationary member support plates line up with the apertures of the parallel truss boom support plates. The support plates receive the pivot pin extending transversely therethrough.

In accordance with another aspect of the invention, the articulating truss boom assembly has a hydraulic assembly connected to the pivot sleeve. The hydraulic assembly includes an actuator and a hydraulic power cylinder securely mounted at a first end to the stationary support member. The hydraulic power cylinder has a hydraulic fluid connector extending therefrom. The hydraulic assembly further includes a moveable plunger arm inserted into a second end of the hydraulic power cylinder to permit translational movement of the moveable plunger arm. An actuator lever is connectable attached to the moevable plunger arm and has an aperature to receive the pivot pin therethrough. Tile actuator lever rotates with respect to the pivot pin and moves the articulating truss boom frame when the moveable plunger arm is in translational movement. A hydraulic control unit is connected to the stationary support member for supplying hydraulic fluid to the hydraulic power cylinder.

The hydraulic assembly further includes a metering valve connected to the fluid connector and operatively associated with the hydraulic power cylinder. The metering valve conducts hydraulic fluid from the hydrualic control unit to the hydraulic power cylinder. A restrictor is removeably inserted within the metering valve. The restrictor has a restricted channel therethrough to limit the hydraulic fluid channeled to the hydraulic power cylinder. Preferably, a plurality of rubber shock absorbing pads is attached to prevent direct contact of the stationary member and the articulating truss boom frame.

Accordingly, one object of the present invention is to provide an articulating truss boom that pivots in a horizonal direction.

Another object of the present invention is to provide an articulating truss boom that pivots in a controlled manner.

Yet another object of the present invention is to provide an articulating truss boom that minimizes metal to metal contact and vibrational swaying.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting embodiments illustrated in the drawings accompanying and forming a part of this specification, wherein like reference numerals designate the same elements in the several views, and in which.

Figure 1:
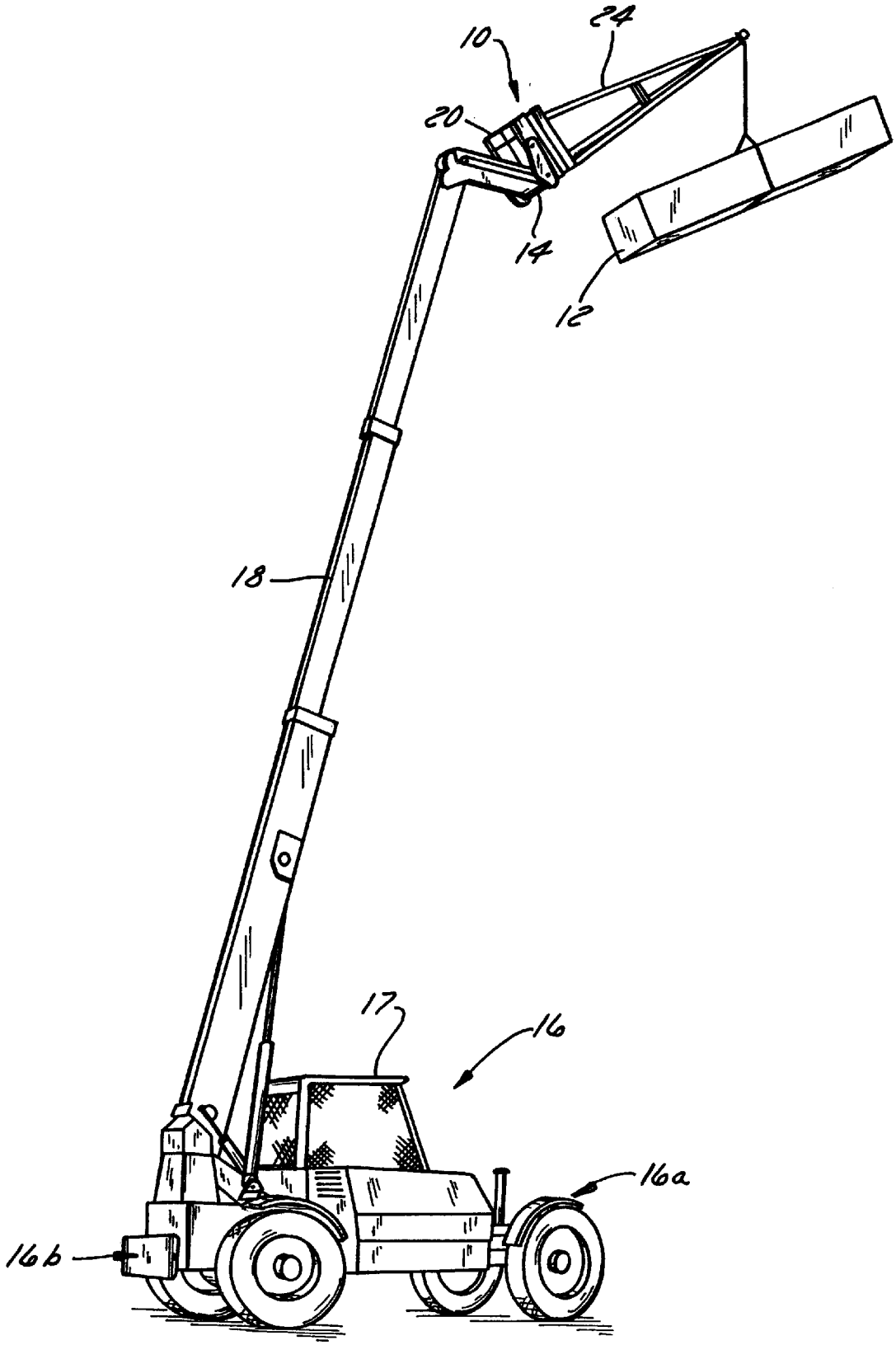
FIG. 1 is a perspective view of a lifting machine utilizing an articulating truss boom in accordance with the present invention.

In describing the preferred embodiment of the invention which is illustrated in the drawings, specific terminology will be resorted to for the sake of clarity. However it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE PREFERRED EMBODIMENTS

The present invention and the various features and advantageous details thereof are explained more fully with reference to the non-limiting embodiments described in detail in the following description.

Referring to FIG. 1 an articulating truss boom assembly is shown and is designated generally by the numeral 10. The articulating truss boom assembly 10 is shown carrying a load 12 and is shown attached to the attachment coupler 14 of the lifting machine 16. The lifting machine 16 is shown utilizing a telescoping boom 18. The lifting machine 16 is of the conventional type and may include such machines as telescopic handlers, fork lifts, or any other machine that may require increased height and/or reach of the implements attached thereto. The handler 16 has a front 16*a*, a rear 16*b* and cab 17. The boom 18 diagonally extends over the cab 17 toward the front 16*a* of the handler 16.

Figure 2:
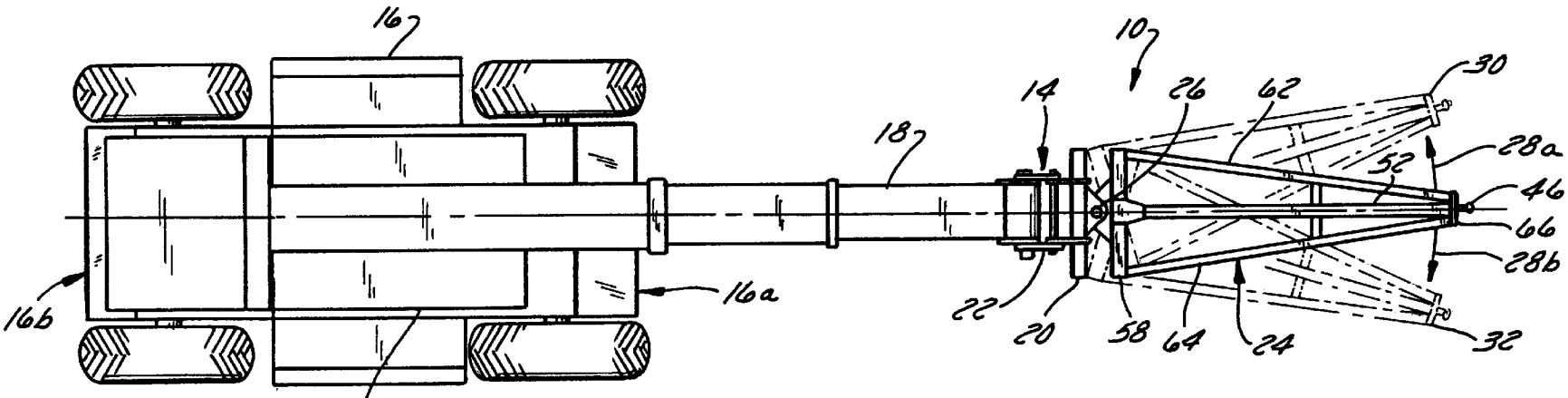
FIG. 2 is top plan view of the lifting machine showing the relative pivoting motion of the articulating truss boom in accordance with the present invention.

Referring now to FIG. 2, the articulating truss boom assembly 10 is shown in its central position. The articulating truss boom assembly 10 includes a stationary support member 20 which is connected to telescoping boom coupler 22. The telescoping boom coupler 22 in a conventional manner is attached to the telescoping boom 18 of the lifting machine 16.

The articulating truss boom assembly 10 also includes an articulating truss boom frame 24 which pivots about pivot assembly 26 with respect to the stationary support member 20. The articulating truss boom frame 24 is capable of pivoting in a plane parallel to the ground and transverse to the pivot assembly 26. In operation, the articulating truss boom frame 24 is capable of following a path indicated by pivot path arrow 28*a* until a full pivot is achieved at position 30 (shown in phantom). Correspondingly, the articulating truss boom frame 24 may also swing in the opposite direction along a path indicated by the pivot path arrow 28*b* until a second maximum pivot position is achieved as is indicated by position 32 (shown in phantom). However, it is contemplated by the present invention to include maximum swings which exceed the swing shown in the disclosed embodiment. It is important to note that the movement shown is a relatively controlled movement even with loads being borne by the articulating truss boom assembly 10.

Figure 3:
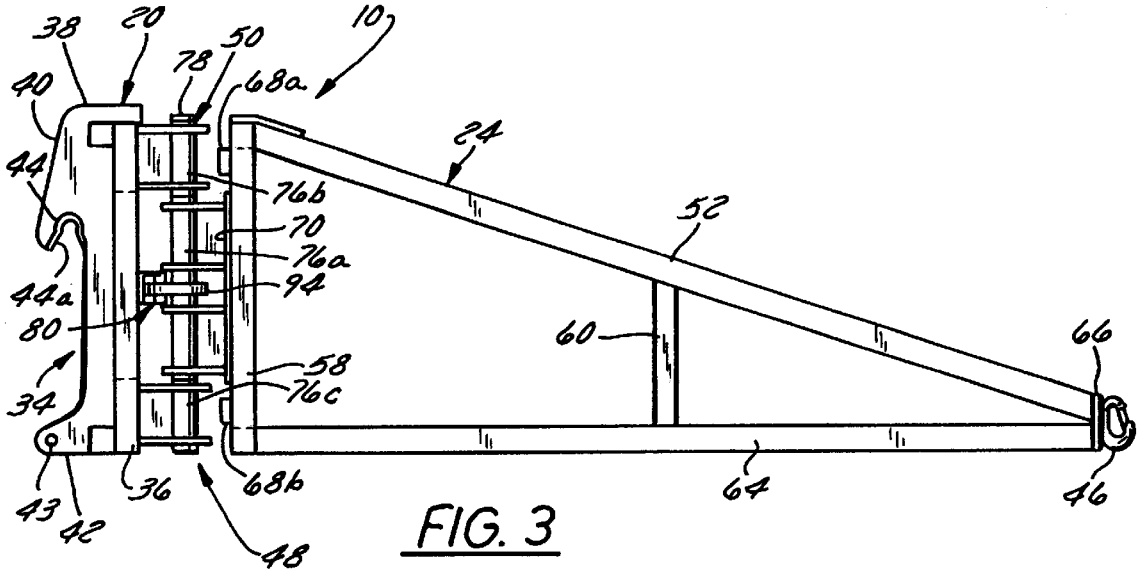
FIG. 3 is a side elevational view of an articulating truss boom in accordance with one aspect of the invention.

Referring now to FIG. 3 a detached articulating truss boom assembly 10 is shown, and includes the stationary support member 20. The stationary support member 20 includes a coupling assembly 34. The coupling assembly 34 includes a support beam 36 and a pair of securing members 38 extending transversely therefrom. Each securing member 38 includes a hook portion 40 and a securing lobe 42. The hook portion 40 has a contour catch 44 with a mouth 44*a* having a larger outer diameter. The securing lobe 42 includes an aperture 43 through which a retaining pin (not shown) may be inserted. The hook portion 40 and the securing lobe 42 are dimensioned to permit ready connection and disconnection from the lifting machine, and is also known as a quick connect feature. These features are sized to permit the articulating truss boom assembly 10 to be attached to TH63 Telescopic Handler lifting machines made by Caterpillar, Inc. of Peoria, Ill. However, one skilled in the art would realize that with modifications the coupling members can be adapted to fit nearly any make and model of lifting machine. Preferably, there is only 1/16 inch play (maximum) between the lifting machine quick disconnect member and the rear of support member. The articulating truss boom frame 24 further includes a load carrying member 46 preferably an industrial one-way latch, for securely carrying the loads to be moved by the articulating truss boom assembly 10.

Interposed between the stationary support member 20 and the articulating truss boom frame 24 is an internal pivot assembly, shown generally at 48. The internal pivot assembly 48 has a vertical pivot axis and provides the connection between the stationary support member 20 and the articulating truss boom frame 24. The vertical pivot axis is coaxial with pivot sleeve 50. In this way, the articulating truss boom frame 24 is capable of pivoting with respect to the stationary support member 20 about the vertical pivot axis in a horizontal plane transversed to the vertical pivot axis.

Figure 4:
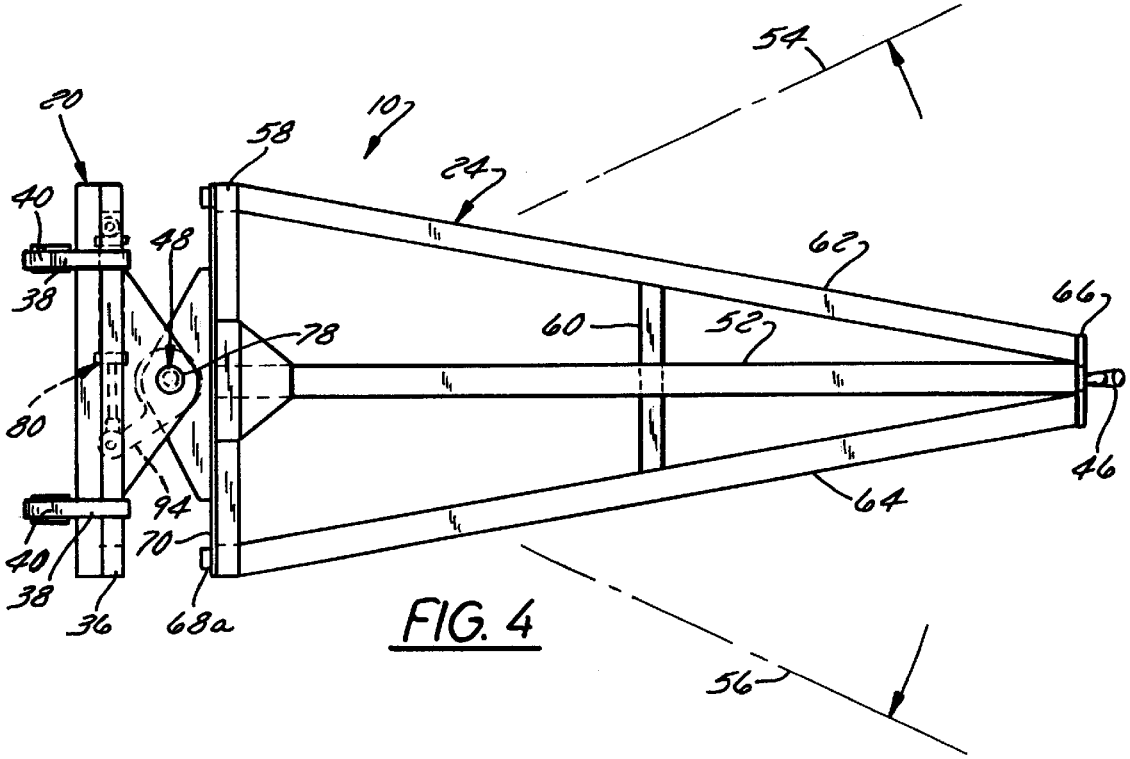
FIG. 4 is a top plan view of FIG. 3 showing the pivoting of the articulating truss boom frame in accordance with one aspect of the invention.

Referring now to FIG. 4, the preferred horizontal swing of the center beam 52 of the articulating truss boom frame 24 is shown. In operation, the articulating truss boom frame 24 can pivot such that the center beam 52 lies in a path coinciding with dashed line 54, which represents a left pivoting limit. In doing so, the load carrying member 46 preferably strikes an arc of approximately 5.25 feet. Similarly, the articulating truss boom frame 24 is also capable of pivoting in the horizontal plane such that the center beam 52 rests in a path coinciding with dashed line 56, which represents a right pivoting limit. Again, in doing so, the load carrying member 46 strikes an arc from center to line 56 of approximately 5.25 feet. In total, then, the articulating truss boom frame 24, in the preferred embodiment shown, is capable of a swing of approximately 10.5 feet. However, arc swings greater than 10.5 feet are contemplated by the present invention.

Figure 5:
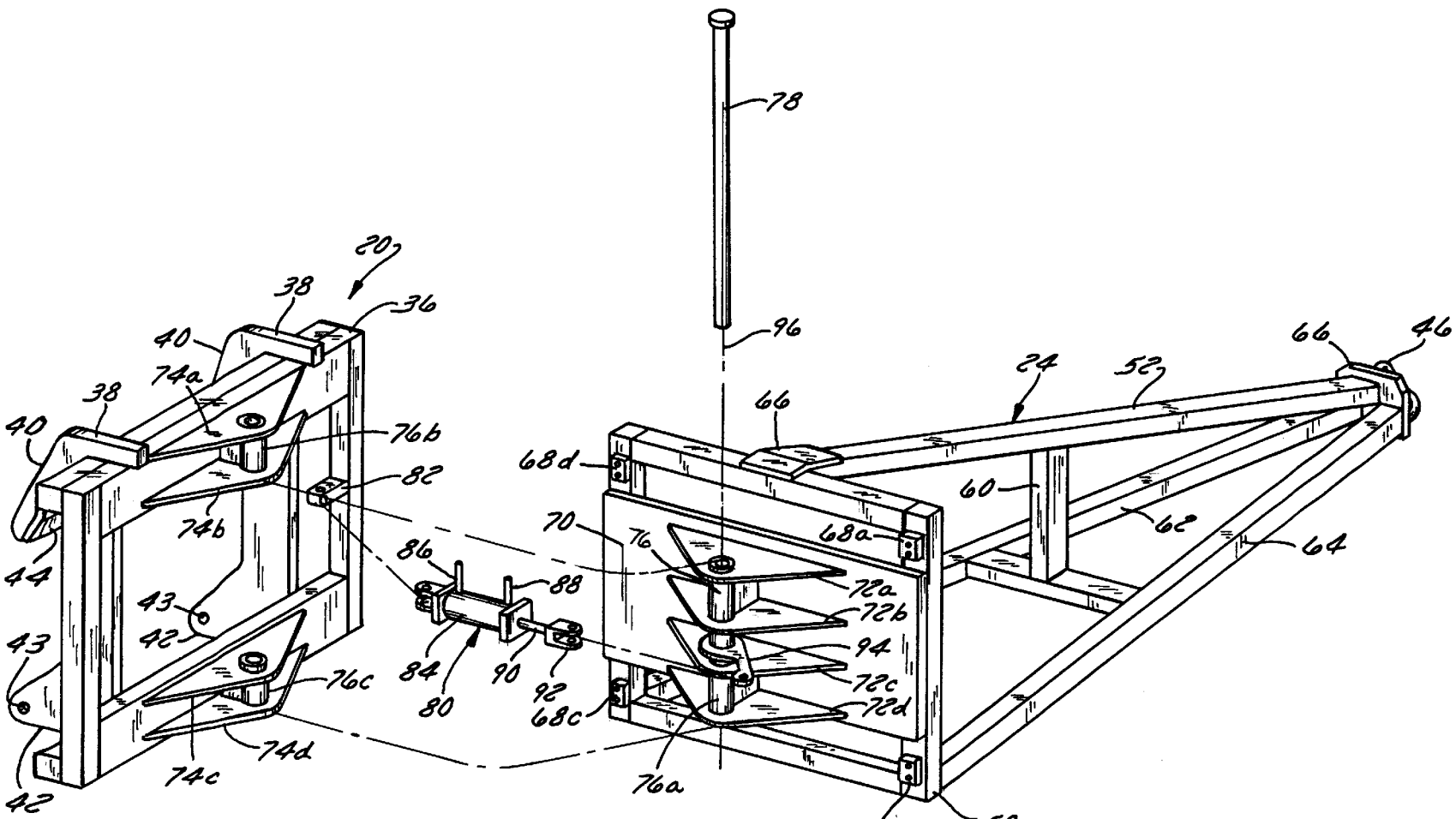
FIG. 5 is a partially exploded view of the articulating truss boom showing the pivot assembly in accordance with one aspect of the invention.

Referring now to FIG. 5, the articulating truss boom frame 24 includes a back portion 58 from which the center beam 52 and two base beams 62, 64 extend and converge and are connected to a front plate 66, to which the load carrying member 46 is attached. A T-support section 60 braces and provides additional strength to the center beam 52 and the base beams 62 and 64. Bracket 66 provides an additional strengthening connection between the center beam 52 and the back portion 58. The back portion 58 includes a plurality of shock absorbing pads 68*a*–68*d*, which are used to absorb the shock that occurs when the articulating truss boom frame 24, during its pivoting action, makes contact with the stationary support member 20. Although four shock absorbing pads are shown, it is understood that a different number of shock absorbing pads could be used, and that the shock absorbing pads 68*a*–68*d* could also be placed on the corresponding area of the stationary support member 20 to achieve the same result. The shock absorbing pads 68*a*–68*d* are preferably made of a rubber material, and they minimize the vibrational swing that occurs when the articulating truss boom frame 24 contacts the stationary support member 20, particularly at full pivoting limits. Also attached between the ends of the back portion 58 is support plate 70.

Extending horizontally from the support plate 70 are a first pair of truss boom frame support plates 72*a*, 72*b* and a second pair of truss boom frame support plates 72*c*, 72*d*. The truss boom frame support plates 72*a*–72*d* are preferably constructed of a high strength material, such as steel, and are welded or otherwise securely attached to the support plate 70.

The stationary support member 20 includes a first pair of stationary member support plates 74*a*, 74*b* and a second pair of stationary member support plates 74*c*, 74*d* extending horizontally therefrom.

Each of the support plates 72*a*–*d* and 74*a*–*d*, includes an opening to receive a pivot sleeve 76*a*–76*c* therethrough. In operation, pivot sleeve 76*a* is grease fitted on either side to receive pivot sleeves 76*b* and 76*c* in order to permit the rotation of pivot sleeve 76*a* with respect to pivot sleeves 76*b* and 76*c*. A pivot pin 78 is then inserted through the pivot sleeves 76*a*–76*c* to secure the articulating truss boom frame 24 to the stationary support member 20.

A hydraulic assembly includes an actuator 80 is attached to the stationary support member 20 via an extending tab member 82. The actuator 80 includes a hydraulic power cylinder 84 into which the hydraulic fluid is pumped by hydraulic lines (not shown) into metering valve 86 and returning hydraulic fluid is discharged via hydraulic outlet 88. Extending from the hydraulic power cylinder 84 is a movable plunger arm 90 that responds to hydraulic fluid pressure within the hydraulic power cylinder 84. A movable plunger arm 90 is attached with linkage 92 to an actuator lever 94. The actuator lever 94 is rigidly secured about the pivot sleeve 76*a* such that movement of the actuator lever 94 results in rotation of the pivot sleeve 76*a*, and therefore the articulating truss boom frame 24. Preferably, actuator lever 94 has a grease fitting as well (not shown). When it is desired to pivot the articulating triss boom frame 24, hydraulic fluid is injected into the hydraulic power cylinder 84. The hydraulic power cylinder 84 forces the movable plunger arm 90 to rotate the actuator lever 94, resulting in pivoting action about the pivot axis represented by dashed line 96. Similarly, to effectuate pivoting in the opposite direction, hydraulic fluid is withdrawn from the hydraulic power cylinder 84, resulting in a compression of the movable plunger arm 90 with subsequent movement of the actuator lever 94 and pivot sleeve 76*a*.

Figure 6:
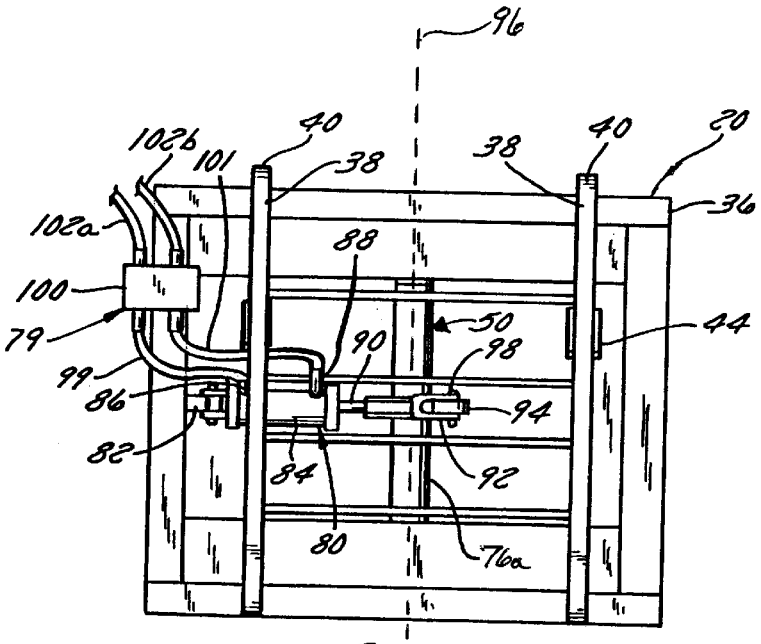
FIG. 6 is a front view of the articulating truss boom assembly showing the location of the actuator in accordance with one aspect of the invention.

Referring now to FIG. 6, the hydraulic power cylinder 84 is shown connected to the moveable plunger arm 90. The moveable plunger arm 90 is held to the actuator lever 94 by a securing pin 98. Preferably, the securing pin 98 is 0.001 inch smaller than the receiving hole to prevent unnecessary twisting of the boom when shifting a load. The hydraulic power cylinder 84 receives hydraulic fluid through the metering valve 86. The metering valve 86 is connected to a fluid connector 99 which conducts hydraulic fluid from a hydraulic control unit 100 to the metering valve 86. The hydraulic control unit 100 also receives a return fluid connector 101 which receives hydraulic fluid from the hydraulic outlet 88. The hydraulic control unit 100 is in communication with a hydraulic fluid supply (not shown) via hydraulic lines 102*a* and 102*b*. It is recognized that hydraulic control unit 100 may take various forms depending on the particular manufacturer's specifications and requirements.

Figure 7:
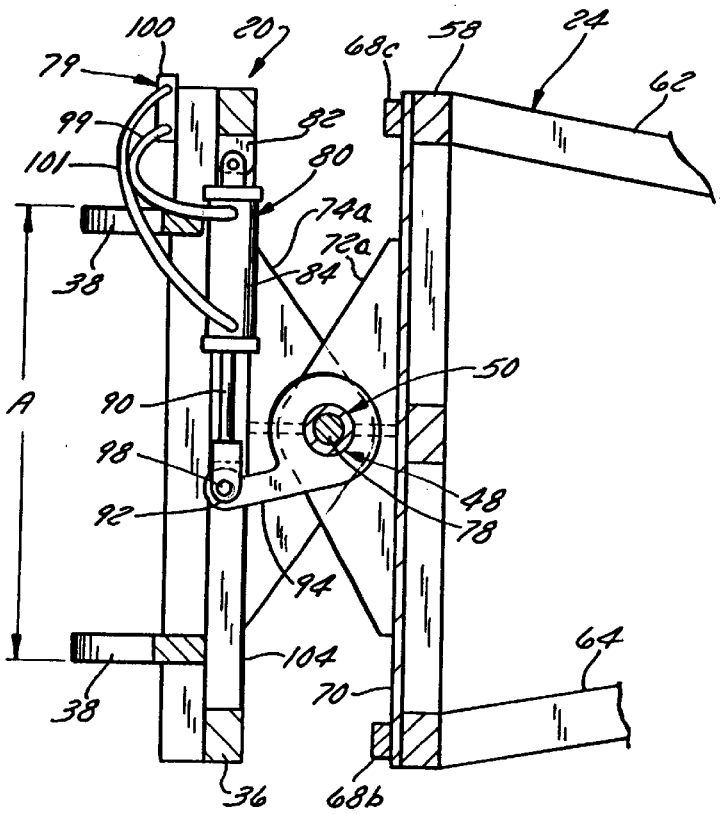
FIG. 7 is a partial top sectional view showing the pivot assembly in accordance with one aspect of the invention.

Referring now to FIG. 7, the truss boom frame support plate 72*a* is shown interlaced with the stationary member support plate 74*a*. Each of the support plates preferably has a generally triangular shape, although any suitable shape is contemplated by the present invention. The benefit of the substantially triangular shape is that the articulating truss boom frame 24 is not stopped from pivoting by the premature contact resulting from the truss boom frame support plates 72*a–d* striking the surface 104 of the stationary support member 20, causing undesirable metal to metal contact. It is important to note that the distance between the securing members 38 of the stationary support member 20, as indicated by A, is specifically selected to engage a lifting machine incorporating a standardized connection system, termed alternatively a quick disconnect system. In the particular embodiment shown. the distance A is approximately 24.125 inches, although any distance between the securing members 38 is acceptable as long as the stationary support member 20 can be attached to a lifting machine. Again, preferably, there is a 1/16 inch tolerance between coupling members 20 and 14.

Figure 8:
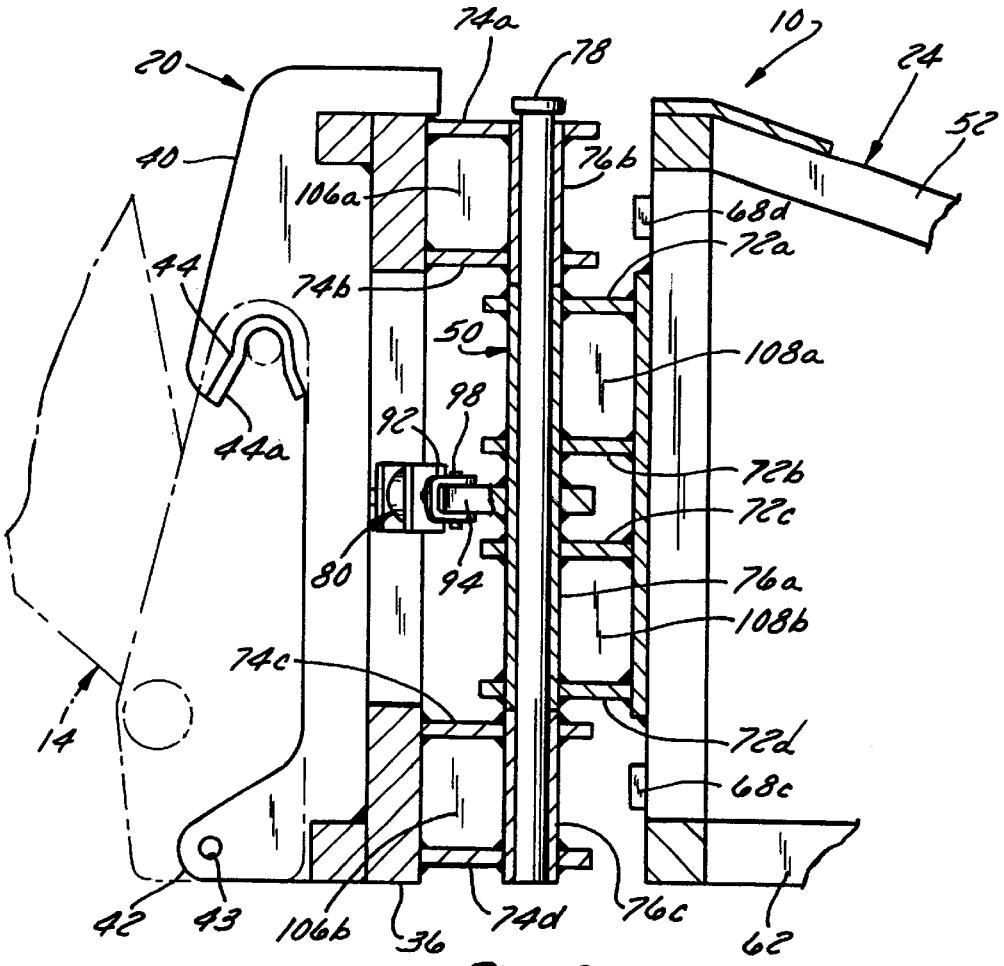
FIG. 8 is a partial side sectional view of the articulating truss boom assembly in accordance with one aspect of the invention.

Referring now to FIG. 8, the attachment coupler 14 (shown in phantom) is shown attached to the stationary support member 20. In order to provide additional structural support in addition to the pivot pin 78, each pair of stationary member support plates 74*a–d* includes a stationary member reinforcement plate 106*a* and 106*b*. Similarly, each pair of truss boom frame support plates 72*a–d* has a frame reinforcement plate 108*a* and 108*b* transversely connected therebetween. Preferably, stationary member reinforcement plates 106*a* and 106*b* and frame reinforcement plates 108*a* and 108*b* are ½ inch steel with a solid I-beam construction. The plates provide additional lifting strength and allow the articulating truss boom frame assembly 10 to pivot with additional support without unnecessary weight.

Figure 9:
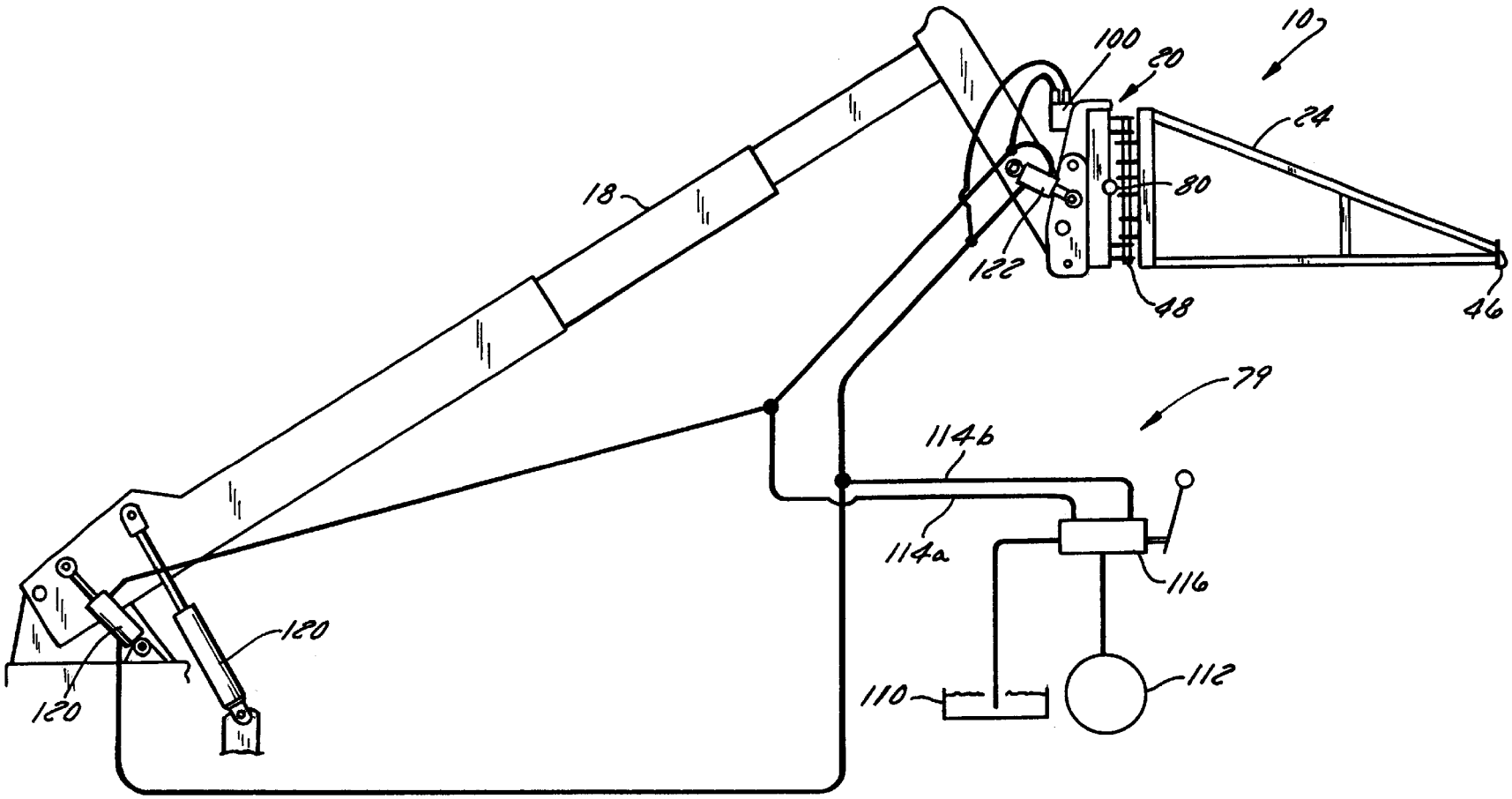
FIG. 9 is a schematic representation of the hydraulic system of the lifting machine utilizing the articulating truss boom in accordance with the invention.

Referring now to FIG. 9, a basic schematic of the hydraulic system is shown. From a hydraulic reservoir 110 hydraulic fuel is pumped via hydraulic pump 112 through hydraulic lines 114*a* and 114*b*. The flow of the hydraulic fluid is operated via control panel 116. The hydraulic fluid is directed towards hydraulic cylinders 120 and 122 associated with the telescoping boom 18. Hydraulic fluid is also directed towards the hydraulic control unit 100.

Figure 10:
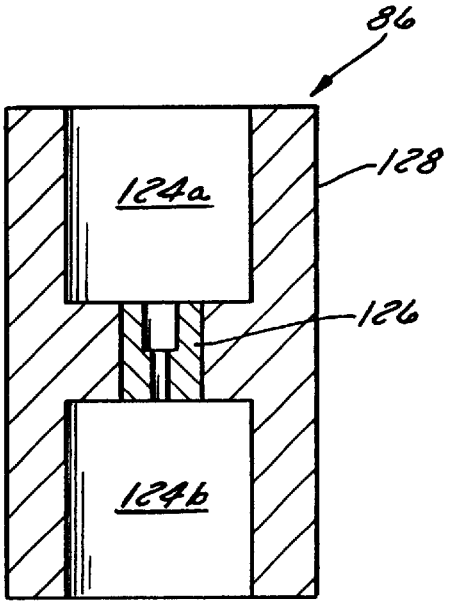
FIG. 10 is a side sectional view of the metering valve in accordance with one aspect of the invention.

Referring now to FIG. 10, a detailed look at the metering valve 86 is shown. The metering valve 86 limits the amount of hydraulic fluid entering the hydraulic power cylinder 84 (not shown). The metering valve 86 includes a pair of metering valve bores 124*a* and 124*b* extending partially therethrough. The size of the metering valve bores 124*a* and 124*b* is selected to properly engage the hydraulic connectors associated with the hydraulic lines and the hydraulic power cylinder 84 so as to provide a connection therebetween. A restrictor 126 is removably inserted between the metering valve bores 124*a* and 124*b*. The restrictor 126 further limits the amount of hydraulic fluid flowing from metering valve bore 124*a* to metering valve bore 124*b*.

Figure 11:
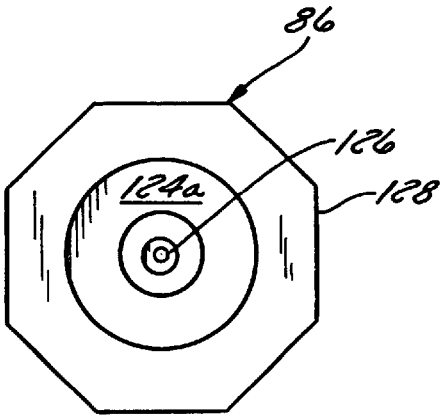
FIG. 11 is a top plan view of FIG. 10 showing the metering valve in accordance with one aspect of the invention.

Referring to FIG. 11, the shape of the metering valve 86 is preferably hexagonal, although any suitable shape is contemplated by the present invention. The metering valve 86 has an outer wall 128 which define the boundaries of the metering valve bore 124*a* which terminates in the restrictor 126.

Figure 12:
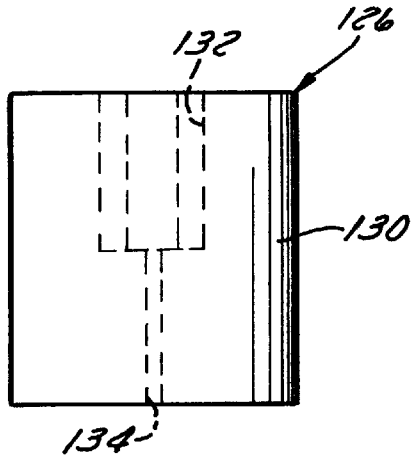
FIG. 12 is a side elevational view of the hydraulic restrictor in accordance with one aspect of the invention.

Referring now to FIG. 12, an enlarged view of the restrictor 126 is shown, and includes a restrictor body 130 which includes a first restricting channel 132 and second restricting channel 134, both shown in phantom. The second restricting channel 134 is smaller in diameter than the first restricting channel 132.

Figure 13:
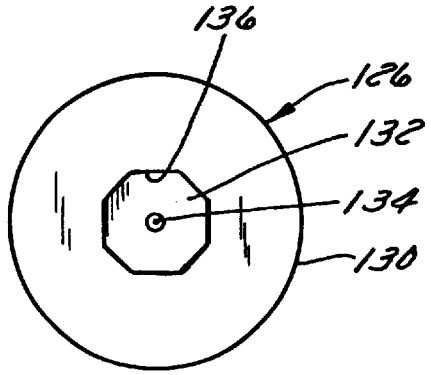
FIG. 13 is a top plan view of FIG. 12 showing the hydraulic restrictor in accordance with one apsect of the invention.

Referring to FIG. 13, the restrictor 126 has a generally circular shape with the first restricting channel 132 having a preferably octagonal outside wall 136. In the embodiment shown, the second restricting channel 134 has a preferred diameter of 0.020 inches. It is the diameter of the second restricting channel 134 that determines the amount of hydraulic fluid into the hydraulic power cylinder 84, and therefore the speed of the articulating truss boom assembly 10. By creating a series of restrictors 126 having second restricting channels 134 of different diameters, simply removing the restrictor 126 and replacing it with a restrictor of a different diameter, different pivoting speeds may be obtained.

Figure 14:
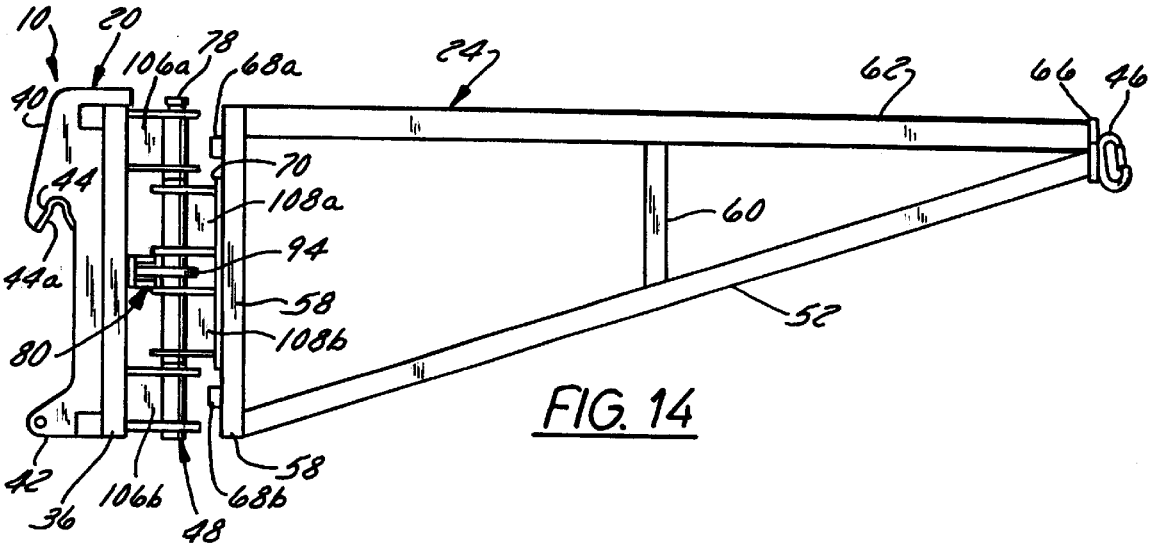
FIG. 14 is a side elevational view of a second embodiment of the articulating truss boom assembly in accordance with the invention.

Referring now to FIG. 14, a second embodiment of the articulating truss boom assembly 10 is shown. In this embodiment, the articulating truss boom frame 24 is inverted such that the center beam 52 extends upward from the bottom of the back portion 58 to intersect with the base beam 62 at the load carrying member 46. The load carrying member 46 is of standard construction, as can be obtained from McMaster Cain, number 34685 T31 Weld-on Hook, which is acceptable. The inversion of the articulating truss boom frame 24 extends the height of the load carrying member 46 by the height of the back portion 58, which is preferably approximately 34 inches. The inverted truss boom frame also allows for horizontal extension of the truss boom assembly 10 with respect to the lifting machine 16.

The present invention has been described in terms of the preferred embodiment, and it is recognized that equivalents, alternatives, and modifications, aside from those expressly stated, are possible and within the scope of the appending claims.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

For example, it is contemplated that the hook portion and the securing member may reside on the attachment coupler 14 of the lifting machine, with the mating portion of the attachment coupler similarily residing on the stationary support member. The swapping of connectors permits the same connection to be made between the stationary support member and the lifting machine but with switched connection mechanisms.

In addition the individual components need not be fabricated from the disclosed materials, but could be fabricated from virtually any suitable materials.

Moreover, the individual components need not be formed in the disclosed shapes, or assembled in the disclosed configuration, but could be provided in virtually any shape and assembled in virtually any configuration, so as to provide the desired horizontal pivoting movement. Furthermore, all the disclosed features of each disclosed embodiment can be combined with, or substituted for, the disclosed features of every other disclosed embodiment except where such features arc mutually exclusive.

It is intended that the appended claims cover all such additions, modifications and rearrangements. Expedient embodiments of the present invention are differentiated by the appended subclaims.

What is claimed is:

1. A telescopic handler having a front and a rear comprising:

1) a cab;

2) a diagonally telescoping boom connected to the rear of the handler and extending over the cab toward the front of the handler; and 3) an articulating truss boom assembly for attachment to the boom comprising:

a) a support member including:

a coupling assembly for coupling the support member to the handler, the coupling assembly comprising a support beam having a support beam plane and a pair of securing members extending from the support beam transverse to the support beam plane, each securing member including a hook portion and a securing lobe having an aperture, the hook portion and the securing lobe capable of locking engagement with the handler, and a first pair and a second pair of parallel member support plates extending from the support member transverse to the support beam plane, wherein at least the first pair of member support plates has a support member reinforcement plate transversely connected therebetween;

b) an articulating truss boom frame having at a first end a retention member and having at a second end i) a first pair of parallel frame support plates which have a frame reinforcement plate transversely connected therebetween and ii) a second pair of parallel frame support plates which have a frame support plates extending outwardly from the truss boom frame transverse to the support beam plane and having a frame reinforcement plate transversely connected therebetween;

c) a pivot pin having a vertical pivot axis interposed between and providing the connection between the support member and the articulating truss boom frame; and d) a hydraulic assembly connected to the pivot pin comprising:

i) an actuator including:

a hydraulic power cylinder securely mounted at a first end to the support member and having a hydraulic fluid connector extending therefrom;

a moveable plunger arm inserted within a second end of the hydraulic power cylinder to permit translational movement of the moveable plunger arm;

an actuator lever connectable attached to the moveable plunger arm and having an aperture to receive the pivot pin therethrough, the actuator lever rotating with respect to the pivot pin and moving the articulating truss boom frame when the moveable plunger arm is in translational movement;

ii) a hydraulic control unit connected to the support member for supplying hydraulic fluid to the hydraulic power cylinder;

iii) a metering valve connected to the fluid connector and operatively associated with the hydraulic power cylinder, the metering valve conducted hydraulic fluid from the hydraulic control unit to the hydraulic power cylinder; and iv) a restrictor removably inserted within the metering valve and having a constricted channel therethrough to limit the hydraulic fluid channeled to the hydraulic power cylinder;

wherein the first pair and the second pair of support member support plates and the first pair and second pair of truss boom frame support plates arc interlaced so that apertures of the support members support plates line up with apertures of the truss boom frame support plates to permit the pivot pin to extend transversely therethrough.

2. The telescopic handler of claim 1, wherein the articulating truss boom assembly further includes a plurality of rubber shock absorbing pads attached to at least one of the member and the articulating truss boom frame to prevent vibrations from the direct contact of the support member and the articulating truss boom frame.

3. The telescopic handler of claim 2, wherein the parallel support member support plates have a generally triangular shape.

4. The telescopic handler of claim 1, wherein the parallel truss boom frame support plates each has a generally triangular shape.

5. The articulating truss boom frame of claim 1, wherein the coupling assembly of the stationary member is sized to a standard dimension for facilitating attachment of the stationary member to the machine.

6. An articulating truss boom assembly for use with a lifting machine that has a telescoping boom, the articulating truss boom assembly comprising:

1) an articulating truss boom frame;

2) a support member attachable to the lifting machine; and 3) an internal pivot assembly having a vertical pivot axis interposed between and providing the connection between the support member and the articulating truss boom frame such that the articulating truss boom frame is capable of pivoting with respect to the support member about the vertical pivot axis in a horizontal plane transverse to the vertical pivot axis; and wherein the internal pivot assembly further includes:

a) a plurality of pairs of parallel member support plates with a member support plate interconnecting one of the pairs of the pairs of support plates, and wherein each pair of parallel member support plates is connected to the support member and has an opening therein;

b) a first pair and a second pair of parallel truss boom frame support plates connected to the articulating truss boom frame, and wherein at least one pair of parallel truss boom frame support plates has an aperture therein and includes a reinforcement plate transversely connected therebetween; and c) a first pivot sleeve connected to the truss boom frame support plates and grease fitted to allow rotation;

d) a second pivot sleeve connected to a first pair of support member support plates;

e) a third pivot sleeve connected to a second pair of support member support plates;

f) a single pivot pin insertable in the support member second and third sleeves and the articulating truss boom frame first sleeve;

g) a plurality of shock absorbing pads attached to at least one of the support member and the articulating truss boom frame to prevent direct contact of the support member with the articulating truss boom frame; and h) a hydraulic assembly connected to the pivot pin:

i) an actuator including:

a hydraulic power cylinder securely mounted at a first end to the support member and having a hydraulic fluid connector extending therefrom;

a moveable plunger arm inserted within a second end of the hydraulic power cylinder to permit translational movement of the moveable plunger arm; and an actuator lever connectable attached to the moveable plunger arm at a first end and the first sleeve at a second end and having an aperture to receive the pivot pin therethrough, the actuator lever rotating the first sleeve with respect to the pivot pin and thereby moving the articulating truss boom frame when the moveable plunger arm is in translational movement;

ii) a hydraulic control unit connected to the support member for supplying hydraulic fluid to the hydraulic power cylinder;

iii) a metering valve connected to the fluid connector and operatively associated with the hydraulic power cylinder, the metering valve conducted hydraulic fluid from the hydraulic control unit to the hydraulic power cylinder; and iv) a restrictor removably inserted within the metering valve and having a constricted channel therethrough to limit the hydraulic fluid channeled to the hydraulic power cylinder.

7. The articulating truss boom assembly of claim 6, wherein the articulating truss boom frame comprises:

a back portion, a center beam extending from the back portion;

two base beams extending from the back portion and converging toward the center beam;

a front plate connected to the center beam and the two base beams;

a generally T-shaped support section connected to the center beam and the base beams; and a load carrying member attached to the front plate.

8. The articulating truss boom assembly of claim 6, wherein the stationary support member further comprises a coupling assembly for coupling the stationary support member to the lifting machine, the coupling assembly comprising a support beam and a pair of securing members extending therefrom, each securing member including a hook portion and a securing lobe having an aperture therein, the hook portions and the securing lobes capable of locking engagement with the lifting machine.

9. The articulating truss boom assembly of claim 6, wherein the coupling assembly of the stationary member is sized to a standard dimension to facilitate attachment of the stationary member to the lifting machine.

10. The articulating truss boom assembly of claim 6, wherein the articulating truss boom frame pivots in the horizontal plane such that the articulating truss boom frame is capable of swinging an arc of up to approximately 10.5 feet.

11. The articulating truss boom assembly of claim 6, wherein the first and second pairs of truss boom frame support plates and the first and second pairs of each has a generally triangular shape.

12. An articulating truss boom assembly for attachment to a lifting machine comprising:

a) a support member including:

a coupling assembly for coupling the support member to the lifting machine, the coupling assembly comprising a supporting beam and a pair of securing members extending therefrom, each securing member including a hook portion and a securing lobe having an aperture therein, the hook portions and the securing lobes capable of locking engagement with the lifting machine, and a first pair and a second pair of parallel support member support plates, wherein each pair of support member support plates has an aperture within and includes a reinforcement plate transversely connecting the paired support member support plates;

b) an articulating truss boom frame having a first pair and a second pair of truss boom frame support plates, each pair of parallel truss boom frame support plates having an aperture and including a truss boom frame reinforcement plate perpendicularly connecting the individual plates within the first and second pairs;

c) a pivot pin interposed between the support member and the articulating truss boom frame;

d) at least four shock absorbing pads attached to at least one of the support member and the articulating truss boom frame to prevent direct contact of the support member with the articulating truss boom frame;

e) a sleeve attached to at least the first and second of pair of truss boom frame support plates for receiving the pin; and f) a hydraulic assembly connected to the pivot pin comprising:

1) an actuator including:

a hydraulic power cylinder securely mounted at a first end to the support member and having a hydraulic fluid connector extending therefrom;

a moveable plunger arm inserted within a second end of the hydraulic power cylinder to permit translational movement of the moveable plunger arm;

an actuator lever connectable attached to the moveable plunger arm and having an aperture to receive the pivot pin therethrough, the actuator lever rotating with respect to the pivot pin and moving the articulating truss boom frame when the moveable plunger arm is in translational movement;

2) a hydraulic control unit connected to the support member for supplying hydraulic fluid to the hydraulic power cylinder;

3) a metering valve connected to the hydraulic control through a fluid connector and operatively associated with the hydraulic power cylinder, the metering valve conducting hydraulic fluid from the hydraulic control unit to the hydraulic power cylinder; and 4) a restrictor removably inserted within the metering valve and having a constricted channel therethrough to limit the hydraulic fluid channeled to the hydraulic power cylinder.

13. The articulating truss boom assembly of claim 12 wherein the first and second pairs of parallel support member support plates are outside of the first and second pairs of parallel truss boom frame support plates and are configured such that the parallel apertures of the support member support plates line up with the apertures of the parallel truss boom frame support plates to receive the pivot pin extending transversely therethrough.

14. The articulating truss boom assembly of claim 13, wherein the articulating truss boom frame pivots in the horizontal pivot plane such that the articulating truss boom frame is capable of striking an arc of up to approximately 10.5 feet.

15. The articulating truss boom assembly of claim 13, wherein the first pair and second pair of truss boom frame support plates and the first pair and second pair of stationary member support plates each has a generally triangular shape.

16. The articulating truss boom assembly of claim 12, wherein the coupling assembly of the support member is sized to a standard dimension for facilitating attachment of the support member to the machine and wherein the metering valve is hexagonally shaped.

* * * * *

UNITED STATES PATENT AND TRADEMARK OFFICE

CERTIFICATE OF CORRECTION

PATENT NO. : 6,336,565 B1
DATED : January 8, 2002
INVENTOR(S) : Joseph J. Merkel et al.

It is certified that error appears in the above-identified patent and that said Letters Patent is hereby corrected as shown below:

Title page,
Item [57], ABSTRACT,
Line 11, change “She” to -- The --.
Line 16, delete “to one of the attached”.
Line 17, change “member” to -- members --.

Column 2,
Line 65, change “connectable” to -- connectably --.

Column 8,
Line 3, change “define” to -- defines --.

Column 9,
Line 58, change “connectable” to -- connectably --.

Column 10,
Line 3, change “conducted” to -- conducting --.
Line 19, change “member” to -- members --.

Column 11,
Line 4, insert -- comprising -- after “pin”.
Line 13, change “connectable” to -- connectably --.

Column 12,
Line 40, change “connectable” to -- connectably --.

Signed and Sealed this

Twenty-fifth Day of June, 2002

*Attest:*

*Attesting Officer*

JAMES E. ROGAN
*Director of the United States Patent and Trademark Office*